US006244855B1

(12) United States Patent
Turk et al.

(10) Patent No.: US 6,244,855 B1
(45) Date of Patent: Jun. 12, 2001

(54) BURNER WITH AIR FLOW ADJUSTMENT

(75) Inventors: Victor J. Turk, Elyria; John M. Laisy, N. Ridgeville, both of OH (US); Len Fisher, Colrain, MA (US)

(73) Assignee: R. W. Beckett Corporation, North Ridgeville, OH (US)

( * ) Notice: Subject to any disclaimer, the term of this patent is extended or adjusted under 35 U.S.C. 154(b) by 0 days.

(21) Appl. No.: 09/371,993

(22) Filed: Aug. 11, 1999

(51) Int. Cl.[7] ..... F23N 1/00; F23C 5/06

(52) U.S. Cl. ..... 431/12; 431/89; 431/189; 431/265; 431/351

(58) Field of Search ..... 431/12, 182, 351, 431/265, 89, 188, 189, 183; 239/402, 406, 405

(56) References Cited

U.S. PATENT DOCUMENTS

| | | | | |
|---|---|---|---|---|
| 1,373,149 | * | 3/1921 | Ray | 239/406 |
| 1,394,567 | * | 10/1921 | McDonald | 239/406 |
| 1,416,574 | * | 5/1922 | Oney | 239/402 |
| 2,242,787 | | 5/1941 | Lieberherr . | |
| 2,325,444 | | 7/1943 | Vroom et al. . | |
| 2,393,897 | * | 1/1946 | Glendenning | 431/265 |
| 2,538,460 | * | 1/1951 | Kaveny | 239/402 |
| 2,585,081 | * | 2/1952 | Bernhard | 431/265 |
| 2,634,806 | * | 4/1953 | Hirtz | 239/406 |
| 2,925,783 | | 2/1960 | Zimmermann et al. . | |
| 3,091,182 | | 5/1963 | Anderson et al. . | |
| 3,153,438 | | 10/1964 | Brozozowski . | |
| 3,154,134 | | 10/1964 | Bloom . | |
| 3,474,969 | * | 10/1969 | Barry | 431/182 |
| 3,556,700 | * | 1/1971 | Jackson et al. | 431/12 |
| 3,658,289 | * | 4/1972 | Hodges | 431/182 |
| 3,694,136 | * | 9/1972 | Flournoy et al. | 431/265 |
| 3,799,733 | * | 3/1974 | Tickell, Sr. | 431/265 |
| 3,852,022 | | 12/1974 | Medeot et al. . | |
| 3,918,885 | * | 11/1975 | Palm et al. | 431/265 |
| 4,162,888 | | 7/1979 | Weishaupt et al. . | |
| 4,177,005 | | 12/1979 | Bozung et al. . | |
| 4,201,538 | * | 5/1980 | Kopp | 431/351 |
| 4,239,482 | * | 12/1980 | Durfee | 431/354 |
| 4,388,064 | * | 6/1983 | Kaplan et al. | 431/265 |
| 4,484,887 | * | 11/1984 | Pettersson | 431/265 |
| 4,519,211 | | 5/1985 | Sedille . | |
| 4,551,088 | * | 11/1985 | Stough | 431/12 |
| 4,566,850 | | 1/1986 | Grzina . | |
| 4,595,355 | * | 6/1986 | Garrelfs et al. | 431/265 |
| 4,651,928 | * | 3/1987 | Schmidt | 431/188 |
| 4,676,717 | | 6/1987 | Willyard, Jr. et al. . | |
| 4,978,293 | * | 12/1990 | Ryno | 431/265 |
| 5,076,782 | * | 12/1991 | Campbell et al. | 431/12 |
| 5,184,949 | | 2/1993 | O'Brien . | |
| 5,219,461 | | 6/1993 | Hyll et al. . | |
| 5,961,316 | * | 10/1999 | Wellman et al. | 431/265 |

FOREIGN PATENT DOCUMENTS

| | | |
|---|---|---|
| 2 247743 | 4/1995 | (GB) . |

* cited by examiner

*Primary Examiner*—James C. Yeung
(74) *Attorney, Agent, or Firm*—Watts Hoffman Fisher & Heinke

(57) ABSTRACT

A burner includes a motor driven blower, an air tube having an inlet end portion and an outlet end portion, a housing forming an air flow path between the blower and the air tube, a nozzle for spraying liquid fuel or orifice for dispersing gas toward the outlet end portion of the air tube and a conduit for feeding the fuel to the nozzle or orifice. An air flow control device and method enable air flow and pressure to be regulated at locations near the nozzle and between the blower and the nozzle.

37 Claims, 5 Drawing Sheets

BURNER WITH AIR FLOW ADJUSTMENT

FIELD OF THE INVENTION

The present invention is directed to burners whose air is supplied by a fan and motor. These include oil burners, gas burners and dual-fuel (gas/oil) burners of any practical size and having air flow adjustment mechanisms.

BACKGROUND OF THE INVENTION

Conventional burners generally include an air tube having a fuel supply conduit (or two for dual fuel) extending axially within the tube. Each fuel supply conduit is connected at one end to a fuel supply pump or gas manifold and terminates at the other end near the end of the air tube where the fuel is dispensed as an oil spray or gas. The fuel is mixed with the air which has been delivered by a motor powered blower. A burner-mounted ignition system is connected to an ignition apparatus that is located adjacent to the fuel nozzle near the exit end of the air tube where it ignites the fuel-air mixture.

Burners of these types employ various mechanisms for adjusting air flow. For example, an oil burner disclosed in U.S. Pat. No. 5,184,949 employs an air gate disposed downstream of the blower for controlling the flow through an air flow passage. This fails to disclose a mechanism to control the total flow while simultaneously controlling the pressure behind the flame retention head, which pressure is important for reliable ignition and flame stability.

SUMMARY OF THE INVENTION

In general, the present invention is directed to a burner comprising a motor driven blower in a housing. An air tube has an inlet end portion and an outlet end portion and may be mounted to the housing. The housing forms an air flow path between the blower and the air tube. In an oil burner, a conduit feeds liquid fuel under pressure to the nozzle at the outlet end portion of the air tube where it sprays the fuel.

One aspect of the invention includes two throttling devices affixed to the fuel conduit coaxial to the air tube, each consisting of a tapered ring and a disk located within the ring and coaxial with it. Throttling together they control the air flow to a value proper for the fuel-input rate. The upstream throttle ring is configured to reduce the upstream pressure to a value determined to provide air to the second plate (the retention plate) to an exit velocity just low enough for reliable ignition and flame stability.

Both throttle rings may have tapers that are converging or diverging. Both minimum and maximum firing rates may be achieved by configuring the cones properly. The adjustment direction for converging and diverging cones should be opposite to one another however.

A mechanism is connected to the fuel conduit (a portion of which is preferably external to the housing) to accurately move it axially, thereby controlling the positions of the rigidly affixed throttle plate and the retention plate simultaneously. Consequently, only a single adjustment setting is needed for any firing rate within the range of the burner.

Referring to more specific features of the invention, the air flow control device adjusts the flow rate and two pressures in the air tube, P1 and P2. P1 is the pressure delivered by the blower. It is high at low flows and diminishes more or less uniformly as the flow increases. P2 is the pressure after the first air flow restrictor, and should be quite low at low rates and gradually higher at higher rates to assure good ignition and stability as the air accelerates through the second air flow restrictor to the flame zone where the pressure is near zero. This means that the throttle ring should close down to the throttle plate at the minimum setting where P1 is high, and should open up rapidly with the flow rate as P1 falls while P2 needs to rise.

A preferred configuration of the first air flow restrictor consists of a round throttle plate surrounded concentrically by a throttle ring, forming a venturi which is carefully configured to maintain P2 as described above. A preferred configuration of the second restrictor consists of a round retention head surrounded by a conical retention ring, forming a venturi, which is tapered to produce the minimum and the maximum flow rates required while P2 varies as specified for stability. In the preferred embodiment, the throttle plate and the retention plate are affixed to the fuel conduit and concentric with the air tube and at a fixed axial distance apart. Also, the throttle ring and retention head are affixed to the air tube at the same fixed axial distance apart. As the adjusting mechanism moves the fuel conduit axially, the throttle plate and retention plate are displaced equally within their respective concentric rings to accurately control the flow and maintain P2 for stable combustion and reliable ignition.

An added advantage of this invention relates to the improved uniformity and higher combustion efficiency of the flame. This results from improved air distribution in the air tube after the throttle where air approaches the flame retention head. To enhance this, several holes are incorporated in the throttle plate.

The present invention advantageously enables air pressure to be simply yet precisely controlled with the air flow control device. A user need not make an adjustment near the blower and a separate adjustment in the air tube. Instead, one air flow control device may be used to meter air pressure and air flow at locations near the nozzle and between the blower and the nozzle. This advantageously achieves a desirable range of pressure near the nozzle and results in uniform air flow. The present invention advantageously may adjust air pressure and flow to a desired level using only the air flow control device, although additional adjustment mechanisms may be used, if desired.

In a preferred embodiment of the present invention, the burner includes an air flow control device comprising a first air flow restrictor disposed between the blower and the nozzle, a second air flow restrictor disposed downstream of the first air flow restrictor relative to the direction of air flow, and a mechanism adapted to adjust the position of both the first and second restrictor plates to control air flow. The mechanism comprises a component connected to the conduit and a member that engages the component so as to move it precisely in either direction. The mechanism and the connected portion of the conduit are preferably external of the housing.

In one aspect of the invention the mechanism comprises an apertured support that extends outwardly from the housing. The mechanism component comprises an arm that is pivotally connected to the housing. A protrusion extends outwardly from the arm. The member comprises a threaded rod carried in the aperture of the support. Stops may be threadingly fixed on the rod so as to flank the protrusion, wherein rotation of the rod causes the stop members to engage the protrusion and pivotally move the arm.

In another aspect of the invention the mechanism comprises an apertured support that extends outwardly from the housing. The component comprises a threaded rod carried in the aperture of the support and fastened to the conduit. The member comprises internal threads that engage the rod, wherein rotation of the member against the support causes movement of the rod.

In another aspect of the invention, the mechanism comprises an arm that is pivotally connected to the housing. The member comprises a rack and pinion, one of the rack and pinion being connected to the housing and the other of the rack and pinion being connected to the arm. Motion that is imparted relative to the rack and pinion pivotally moves the arm.

Yet another aspect of the invention is directed to the component comprising at least one plate connected to the conduit. The member is eccentric such that movement of each plate is effected by rotating the member. The mechanism preferably comprises a plurality of plates each containing a conduit opening for receiving the conduit and an opening for receiving the member. A location of the conduit opening in one of the plurality of plates may be offset from a location of the conduit opening in another of the plurality of plates. Each plate comprises an oblong shaped opening that receives the member. Rotation of the member in the oblong shaped opening enables movement of the plate within a predetermined range of distance.

Many additional features, advantages and a fuller understanding of the invention will be had from the accompanying drawings and the detailed description that follows.

DETAILED DESCRIPTION OF PREFERRED EMBODIMENTS

Figure 1:
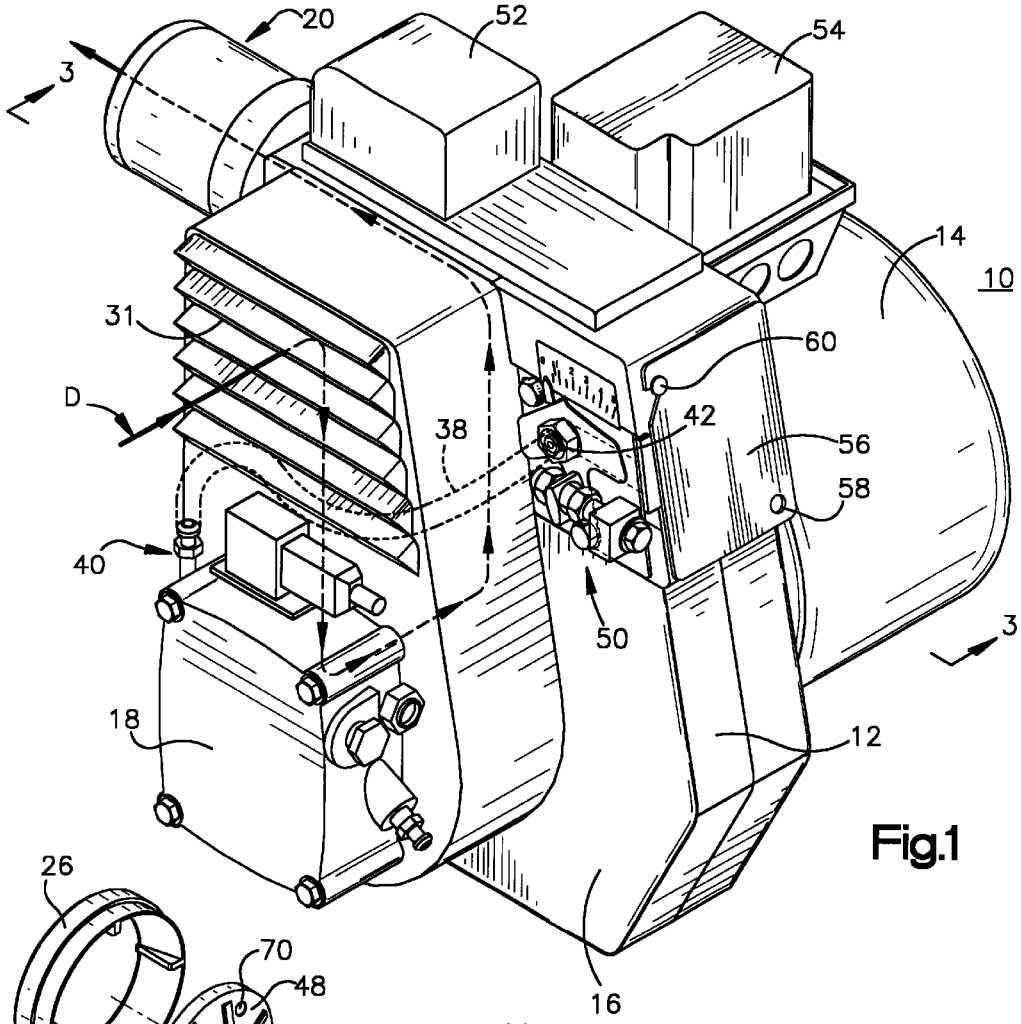
FIG. 1 is a perspective view of a burner constructed in accordance with the present invention.
Figure 2:
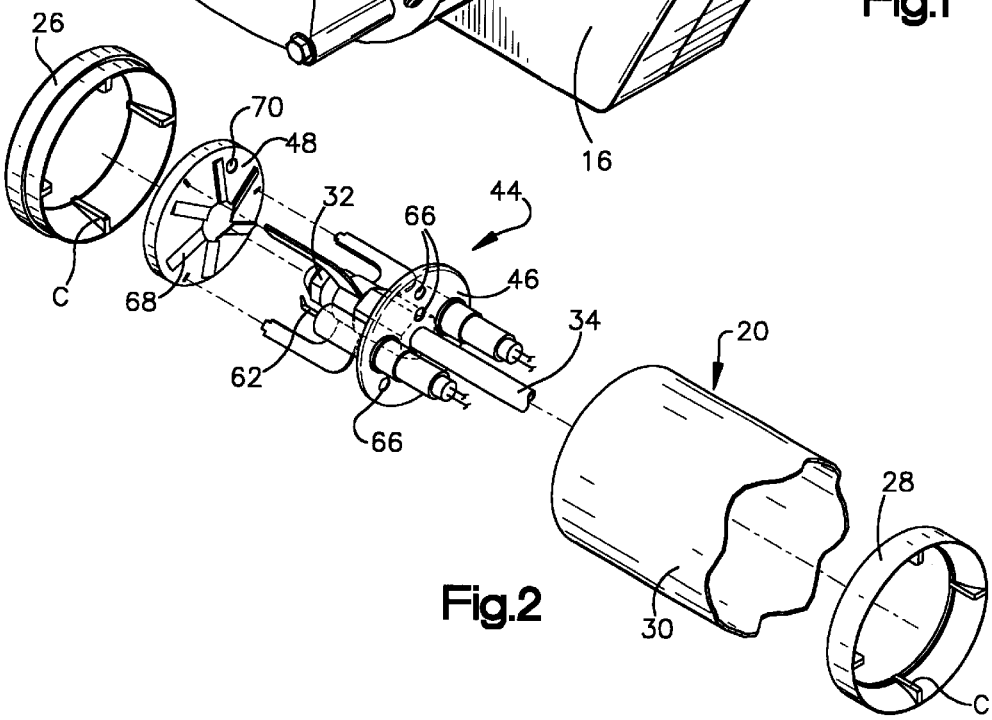
FIG. 2 is an exploded perspective view depicting a portion of the burner shown in FIG. 1.
Figure 3:
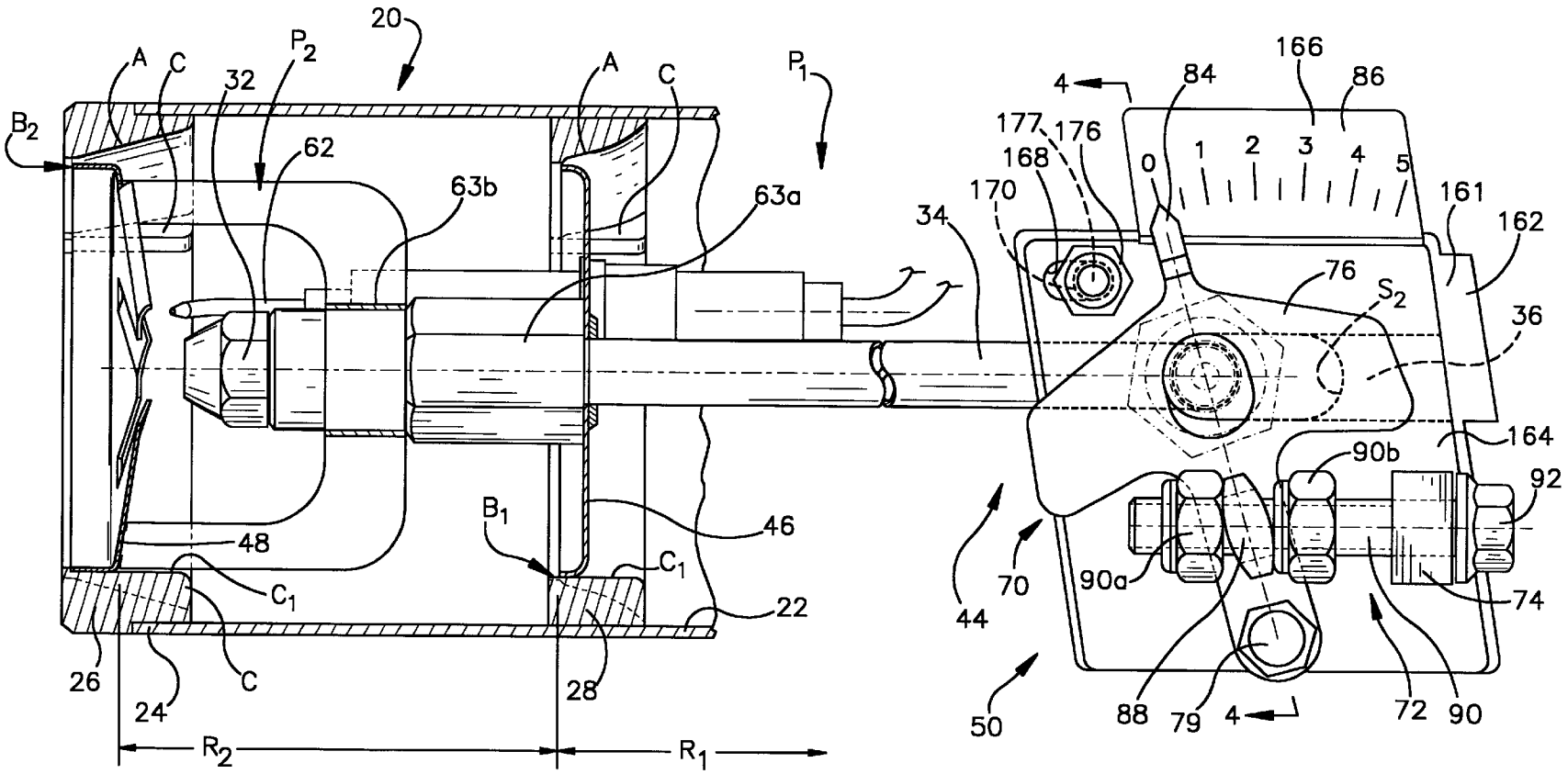
FIG. 3 is a cross-sectional view showing components at an air tube portion of the burner and one embodiment of an air flow control mechanism that operates pivotally.

Referring now to FIGS. 1–3 of the drawings, the present invention is a "gun type" oil burner generally shown at 10. The burner includes a housing 12. Contained in the housing is a motor 14 and a blower 16 that is powered by the motor, the locations of which are generally shown in FIG. 1. A fuel pump 18 that is also powered by the motor is attached to the housing and has various inlet and outlet fittings as are known in the art. An air tube 20 is fastened to the housing and has an inlet end portion 22 and an outlet end portion 24. The air tube has two restrictive sections 26 and 28 connected to a body 30 of the air tube. The housing forms an air flow path from an air inlet 31 to the blower and then through the air tube. The air flow path is depicted generally by dotted lines D. A nozzle 32 sprays oil toward the outlet end portion of the air tube. Oil from a fuel supply is pumped by the fuel pump through the conduit 34. The conduit extends within the housing and bends so as to extend out of a slot 36 formed in the housing. The housing may be formed of a plastic material or of metal (e.g., aluminum). A portion of conduit 38 leads from an outlet coupling 40 of the fuel pump and is connected to the conduit 34 with coupling 42 or one of the other couplings described hereafter.

An air flow control device 44 comprises a first or throttle plate 46 disposed at a location between the blower and the nozzle and fitting and moving inside throttle ring 28 and a second plate or retention head 48 disposed near the nozzle and fitting and moving inside retention ring 26. The throttle plate and retention head are connected to the conduit 34. The air flow control device also includes a head adjustment mechanism 50 for moving the conduit and thereby adjusting the position of the throttle plate and retention head within the throttle and retention rings, respectively, for controlling air flow and pressure.

A transformer 52 or other ignition device is mounted to the burner. Also included is an electrical controller 54 with a safety mechanism that regulates the operation of the burner in a well known manner. A back door 56 is pivotally mounted to the housing with fastener 58 and can be locked with fastener 60, once swung in place. The back door enables easy access to the interior of the burner. Electrodes 62 extend near the nozzle for igniting the fuel-air mixture into flame. The fuel may be any suitable combustible gaseous or liquid fuel such as oil. Although the burner shown in the drawings utilizes oil as the fuel, modifications to the burner suitable for enabling the use of gaseous fuel would be apparent to one skilled in the art in view of this disclosure.

As shown in FIG. 3, the throttle plate is fitted onto the conduit and held in place such as against the back of interiorly threaded member 63*a* which is threaded onto the conduit. A spider 63*b* is held in place on the member 63*a* and holds the retention head to the conduit by fingers that extend into openings in the retention head 48. Insulators of the electrodes 62 are connected to the throttle plate. The electrodes (only one of which is seen in FIG. 3) extend to a point near the nozzle for igniting the spray of oil to produce flame. The electrodes are electrically connected to the transformer or other ignition device.

The throttle ring 28 is disposed around the periphery of the throttle plate 46 and fixed to the air tube. The retention ring 26 is disposed around the periphery of the retention head 48 and fixed to the air tube. The throttle and retention rings each form a venturi in the air tube. The throttle plate and retention head move within the respective venturis. As shown in FIG. 3, the throttle and retention rings have tapered cross-sectional surfaces that extend from near the air tube progressively inwardly relative to the air flow direction. Each of the throttle plate and retention head has a circumferential surface that is sized so as to form apertures of various widths with the tapered cross-sectional surfaces of the throttle ring and retention ring, respectively. The circumferences of the throttle plate and retention head are held concentrically within the throttle ring and retention ring, respectively, by ribs C disposed about the circumference of the rings. The ribs C are concentric and their innermost portions C1 extend parallel to the central axis of the air tube for guiding the retention head and the throttle plate. A first aperture B1 begins to be formed between the surface of the throttle plate that is closest to the air tube outlet, and the corresponding surface of the retention ring, and a second aperture B2 begins to be formed between the surface of the retention head that is closest to the air tube outlet, and the corresponding surface of the retention ring. These apertures B1 and B2 are variable and increase in size when the retention head and throttle plate are moved away from the outlet end portion of the air tube. The apertures may be formed by a tapered surface in the ring and mating surface in the plate or by other shapes of these components, as long as the apertures achieve the desired pressure and flow characteristics in accordance with the present invention.

The throttle plate 46 has openings 66, some of which are shown in FIG. 2, for enabling sighting of the flame and for contributing to desired metering of air pressure and flow downstream of the throttle plate. The retention head 48 has a plurality of vaned openings 68 that provide for desirable air flow downstream of the retention head near the nozzle. The purpose of the vanes is for air/fuel mixing and flame shaping, as known to those skilled in the art. The retention head is also provided with an opening 70 for sighting the flame.

The inventive air flow control device advantageously enables air to be metered to a desired pressure and flow. In particular, the air flow control device is designed to achieve a desired pressure in the region R2, for example, a pressure of about 1 inch water column. Air in a first region R1 between the blower and the throttle plate is at a pressure P1 ranging from 1.75 to 4.50 inches water column (depending on flow). The pressure P1 is directly reduced by a first flow restrictor, (e.g., the throttle plate and ring) to a pressure P2 ranging from 0.4 to 1.1 inches water column (depending on flow). The pressure P2 in the region R2 is obtained in accordance with the present invention as a result of the air flow and pressure drop across the throttle plate and ring as well as across the retention head and ring.

The present invention advantageously meters the flow of air so that the air has a desired pressure near the nozzle in the region R2. The invention contemplates various ways to accomplish this result such as the use of multiple air flow restrictors or portions thereof that may move together or independently of one another, flow restrictors or portions thereof connected to the conduit that move upon movement of the conduit, and flow restrictors or portions thereof that are moved with mechanisms that do not rely upon movement of the conduit. In addition, the flow restrictor portions need not be plate shaped, but rather, may be any shape that enables air to be metered to a desired pressure near the nozzle in the region R2 downstream of the first air flow restrictor.

More specifically, the present invention preferably moves the throttle plate and retention head to enable the desired pressure and flow to be achieved. A preferred aspect of the invention moves the throttle plate and retention head simultaneously. The simultaneous movement of both the throttle plate and retention head with the air flow control device, enables the air flow and pressure to be conveniently controlled with a single adjustment. However, it will be appreciated by those skilled in the art in view of this disclosure that more than two plates may be used, that the plates may have different numbers and shapes of openings, and that the plates and rings may employ different geometric shapes.

The throttle ring and throttle plate meter air pressure and flow that are delivered to the retention ring and retention head. The retention ring and retention head meter air and provide mixing of air with fuel from the fuel nozzle for combustion. The throttle plate and retention head are moved toward the outlet end portion of the air tube to decrease air flow and control air pressure for decreased fuel firing rates such as those ranging from ½ gallon (gal) to ¾ gal per hour. The throttle plate and retention head are moved back away from the outlet end portion of the air tube to increase air flow and control air pressure for increased fuel firing rates such as those ranging from 1¹⁄₁₀ gal to 1¾ gal per hour. The throttle plate and retention head can also be moved back to increase air flow for excess combustion air, if desired.

Figure 4:
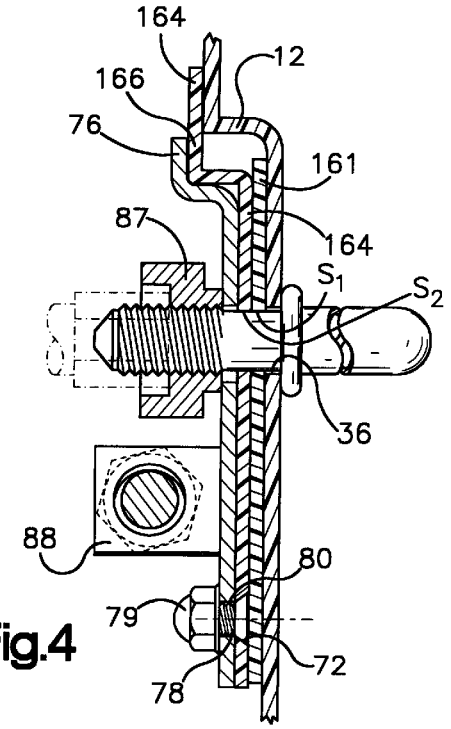
FIG. 4 is a view as seen along the lines designated 4—4 in FIG. 3.

The head adjustment mechanism comprises a component connected to the conduit and a member that moves so as to impart motion to the component and thus, the conduit. A portion of the conduit 34 that extends externally of the housing is connected to the component of the mechanism. One form of the head adjustment mechanism is shown in FIGS. 3 and 4. The mechanism comprises an anchor or support 74 that extends outwardly from the housing and is connected to an intermediate plate 164. The component 70 comprises an arm 76 that is pivotally connected to the intermediate plate 164 such as by stud 78 and nut 79 as will be described in more detail hereafter. The arm preferably has a pointer portion 84 that points to readings on an indicator 86 that correspond to desired firing conditions. A coupling 87 is threaded onto a portion of the conduit 34 to lock the conduit to the arm. A cam shaped, apertured protrusion 88 extends outwardly from the arm and is disposed between nuts or stops **90*a*, 90*b* that are fixed in place on a threaded rod or bolt 90 carried by the support 74. Rotation of a head 92 of the rod causes the stop members to engage the protrusion and pivotally move the arm in view of the cam shape of the protrusion. When the bolt is rotated so as to pull the nut 90*a* against the protrusion to the right in the view shown in FIG. 3, the arm and conduit are retracted away from the air tube outlet to enable greater air flow in the air tube at the first and second air flow restrictor areas. Conversely, when the bolt is rotated so as to push the nut 90*b* and move the protrusion to the left in the view shown in FIG. 3**, the arm and conduit are moved toward the air tube outlet to restrict more air flow. The bolt may be turned by relatively small increments to enable precise air flow and pressure control as shown on the indicator.

Figure 5:
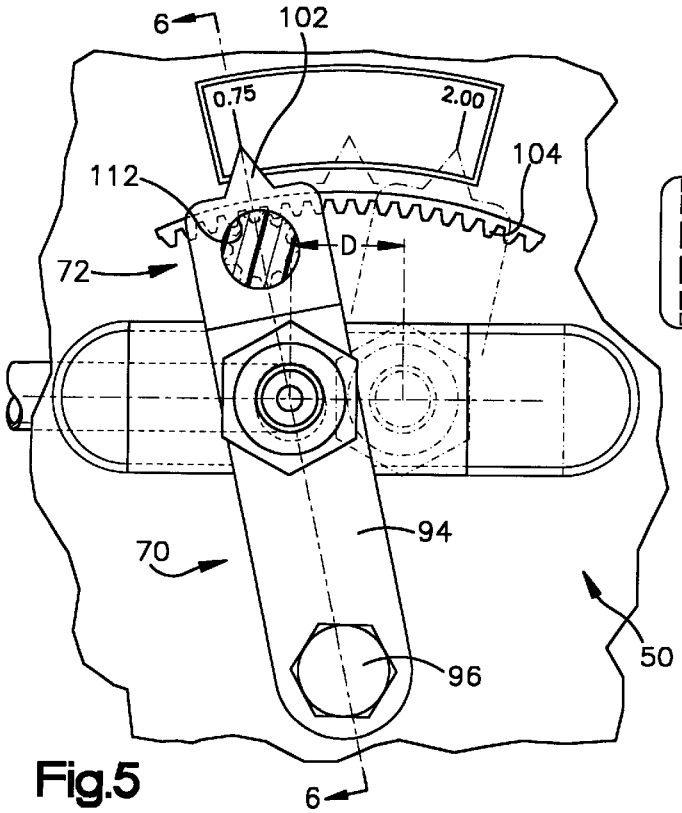
FIG. 5 is a view depicting another embodiment of the air flow control mechanism that operates using a rack and pinion.
Figure 6:
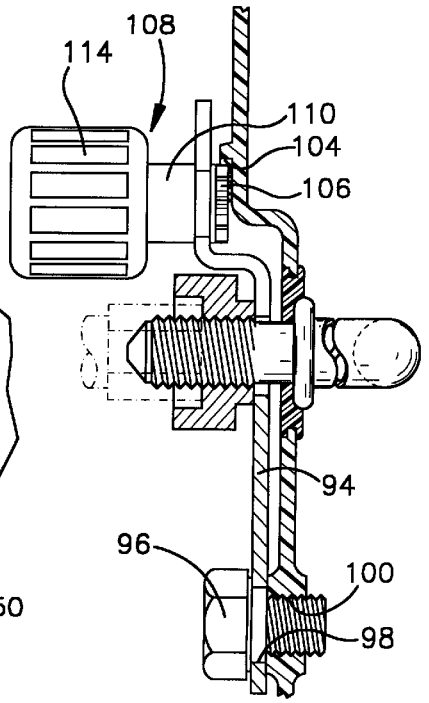
FIG. 6 is a cross-sectional view as seen from the lines designated 6—6 in FIG. 5.
Figure 7:
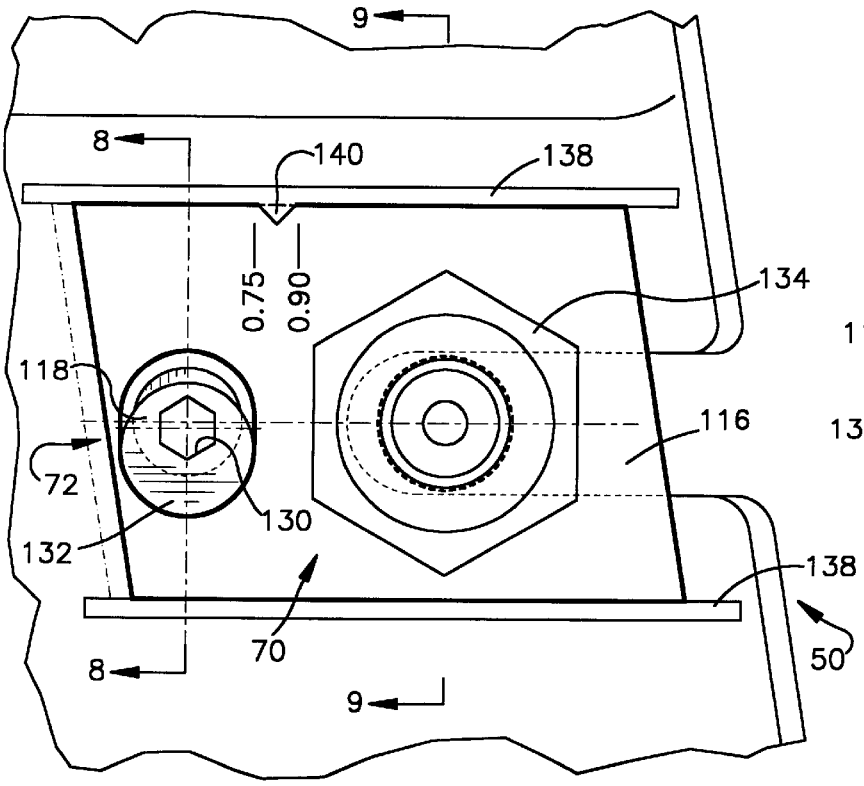
FIG. 7 is a view depicting another embodiment of the air flow control mechanism.
Figure 8:
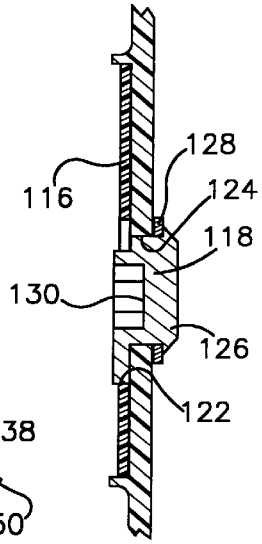
FIG. 8 is a cross-sectional view as seen along the lines designated 8—8 in FIG. 7.
Figure 9:
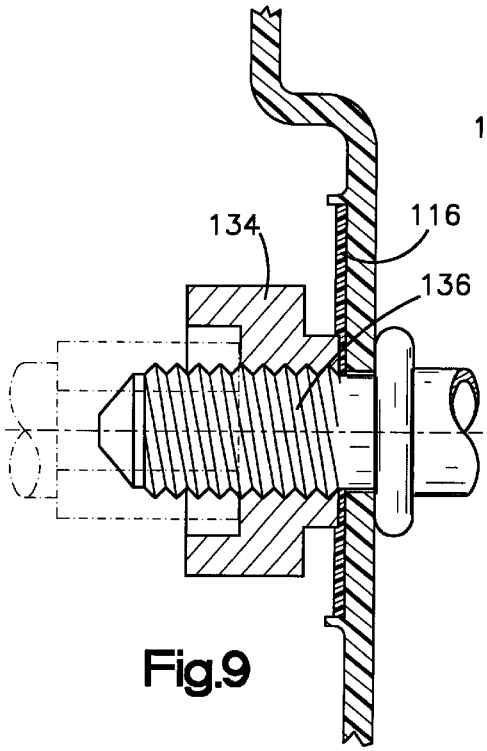
FIG. 9 is a cross-sectional view as seen along the lines designated 9—9 in FIG. 7.

Another head adjustment mechanism shown in FIGS. 5 and 6 comprises a component 70 that includes an arm 94 that is pivotally connected to the housing such as by a bolt 96. The bolt 96 extends through an opening 98 in the arm and into a threaded opening 100 formed in the housing. The arm includes a pointer portion 102 that points at readings on an indicator that correspond to desired firing conditions. The member 72 comprises a rack 104 and pinion 106. The rack is connected to the housing. A rotatable component 108 includes a shaft 110 that extends through an opening 112 in the arm and the pinion 106 that is configured so as to engage the rack. When a dial 114 is rotated, it causes the pinion to move along the rack, which pivots the arm and, in turn, moves the conduit. Clockwise rotation of the dial causes the arm to pivot to the left as depicted in the view of FIG. 5 and moves the conduit toward the air tube outlet, resulting in more restricted air flow. Counterclockwise rotation of the dial causes the arm to pivot to the right as seen in the view of FIG. 5 and retracts the conduit from the air tube outlet, resulting in more air flow.

Another embodiment of the head adjustment mechanism is shown in FIGS. 7–11 and comprises at least one plate 116, one of which is connected to the conduit at a time. The member 72 is in the form of an eccentric 118. Rotation of the eccentric moves each plate. The mechanism preferably comprises a plurality of plates 116 (only one of which is shown) each containing an opening 120 for receiving the conduit and an opening 122 for receiving the eccentric. The eccentric may be received in an opening 124 in the housing and at an inward end may include a shoulder 126. Between the shoulder 126 and the housing is a snap-fit ring 128 or the like for rotatably securing the eccentric to the housing. The eccentric has a socket 130 disposed in an offset location so as to form a major plate engaging section 132. A coupling 134 may be threaded onto threads 136 of the conduit 34 to lock the conduit to the plate. The plate may be received by upper and lower guides 138. A pointer 140 extends from one of the guides and indicates the fuel firing rate with readings printed on each plate.

A location of the conduit opening 120 in one of the plates is offset from a location of the conduit opening 120 in another of the plates. For example, the conduit opening may be displaced in succession from the eccentric opening by a distance of ⅛ inch from a previous plate in the series of plates. The plates are used one at a time. Therefore, a first plate in the series of plates with its conduit opening all the way to the left enables the lowest fuel firing rate with a range determined by the degree of movement of the eccentric. A second successive plate in the series of plates with the conduit opening displaced ⅛ inch further right than the first plate would have a higher fuel firing rate compared to the first plate with the same range of fuel firing rates as the first plate, and so on for successive plates. For example, when a higher fuel firing rate is desired, the plate would be replaced by one in which the conduit opening is spaced further to the right away from the eccentric opening.

Figure 10:
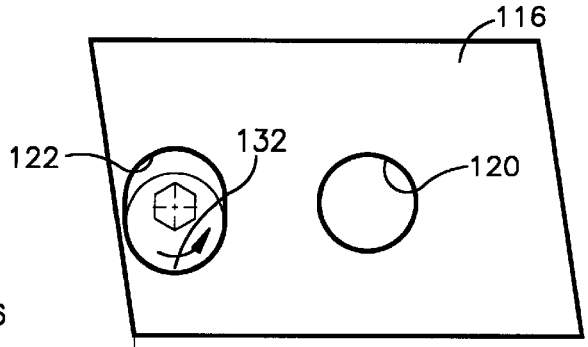
FIGS. 10 and 11 depict movement of a plate of the air flow control mechanism of FIG. 7.
Figure 11:
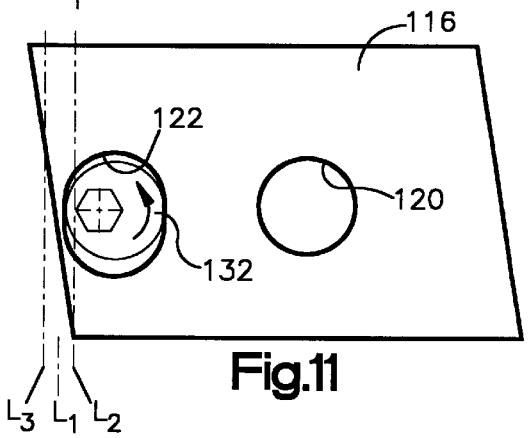

As shown in FIG. 10, the plate is in a neutral position that is not being moved by the eccentric. Counterclockwise rotation of the eccentric moves its plate engaging section 132 and, in turn, moves the plate to the right from a position L1 to a position L2 shown in FIG. 11. This moves the conduit out and increases the amount of air flow. Conversely, clockwise rotation of the eccentric from the position shown in FIG. 10 moves the engaging section and, in turn, moves the plate to the left from the position L1 to the position L3 shown in FIG. 11. This moves the conduit in toward the air tube outlet and increases the restriction of air flow.

Figure 14:
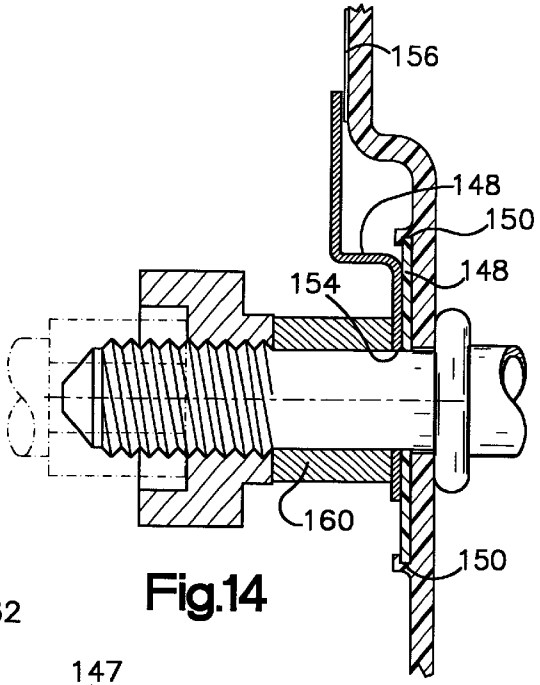
FIG. 14 is a cross-sectional view as seen along the lines designated 14—14 in FIG. 12.
Figure 13:
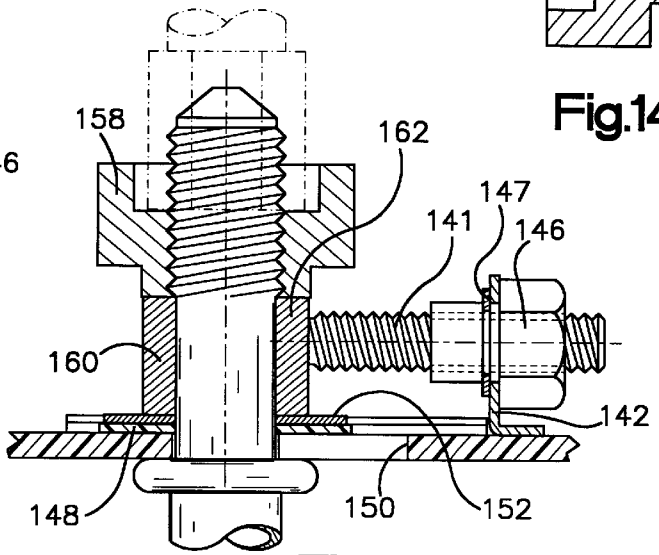
FIG. 13 is a cross-sectional view as seen along the lines designated 13—13 in FIG. 12.
Figure 12:
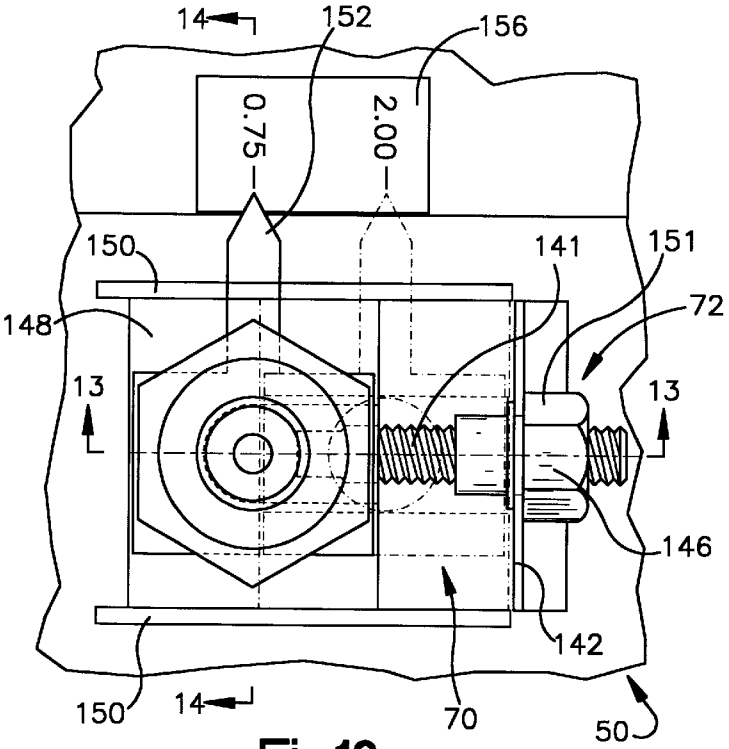
FIG. 12 is another embodiment of the air flow control mechanism that moves linearly.

Yet another embodiment of the head adjustment mechanism is shown in FIGS. 12–14 and comprises a support 142 that extends outwardly from and is connected to the housing. The component 70 comprises a threaded rod 141 carried in an aperture of the support. An internally threaded member such as a nut 146 is rotatably secured to the rod such as with a snap-fit ring 147 on a collar of the nut, or the like. A plate 148 is secured to the housing between upper and lower guides 150. A slot 151 is formed in the housing. A pointer 152 may include an aperture 154 that receives the conduit. An indicator plate 156 may be secured to the housing as shown in FIG. 12. The conduit 34 is connected to the housing by an interiorly threaded coupling 158. A collar member 160 is disposed between the coupling and the plate 148. The rod 141 is fastened to the collar 160 such as by welding. Rotation of the nut 146 on the rod 141 and against the support 142 causes the rod and, in turn the conduit, to move linearly either to the left or right as depicted in FIG. 12 and causes the conduit to move in and out, respectively. As shown in FIG. 12, movement of the rod to the left increases restriction of air flow whereas movement to the right increases air flow. The plate 148 may move with the arm and covers portions of the slot 151.

Figure 3A:
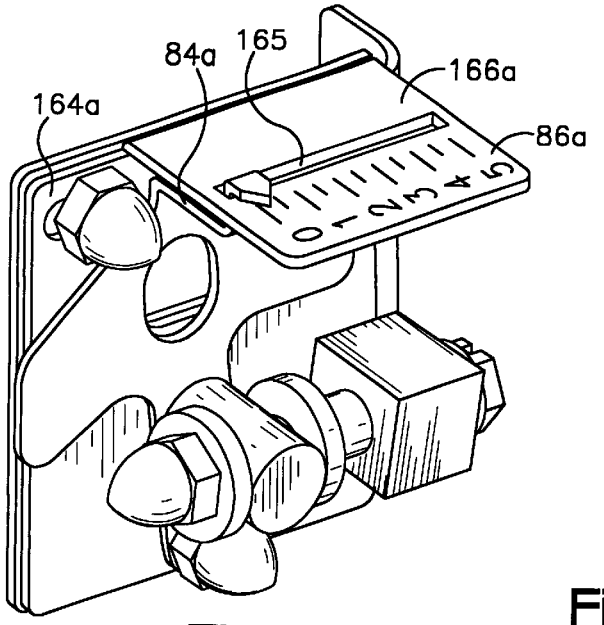
FIG. 3A is a perspective view showing another aspect of the air flow control mechanism of FIG. 3.

The head adjustment mechanism is zeroed in using the mechanism of FIGS. 3 and 4, for example, by a procedure that includes inserting the conduit-head-electrode subassembly all the way to the outlet end of the air tube where it engages the ring 26 and stops. A back plate 161 of the mechanism includes a portion 162 that bends around the corner of the burner and is trapped by the door 56. The back plate 161 has a slot S1 that corresponds to the slot 36 formed in the housing. Disposed on the back plate is an intermediate plate 164, which includes a bent portion 166 that forms the indicator 86. Another aspect of the air flow control mechanism is shown in FIG. 3A which is similar to FIG. 3 and where like numerals designate like parts. A pointer portion 84*a* is bent to extend through an opening 165 in a bent portion 166*a* of indicator 86*a* that forms a part of the intermediate plate 164*a*. The intermediate plate has a slot S2 that corresponds to the slot 36 in the housing but is shorter. A zeroing slot 168 is disposed in the intermediate plate 164, for accommodating variations in tolerance. The stud 78 passes through the opening 80 in the arm, is staked in countersunk opening 172 in the intermediate plate, and held in place with nut 79 to act as a pivot point for the arm. With the conduit furthermost toward the air tube outlet, the arm and intermediate plate are moved together as an assembly on the fixed backplate so as to position the pointer at the zero position on the indicator of the plate. A zeroing nut 176 threadingly engages a stud 177 that is passed through the slot 168 in the intermediate plate 164 and is staked into an opening 170 in the backplate 161 to lock the plates in position. Any of the mechanisms described may be adapted to utilize the zeroing procedure described above.

The mechanism is operated in the manner described to regulate air flow and pressure in the second region R2. The air flow control device regulates air at a pressure P1 in the first region R1 to reduce the pressure P1 to a pressure P2 in the second region R2. This is accomplished by moving the conduit either in or out of the air tube into the flow restricting or flow increasing positions. Therefore, the invention advantageously enables easy, consistent and precisely controlled air pressure and uniform air flow in the burner.

Many modifications and variations of the invention will be apparent to those skilled in the art in light of the foregoing disclosure. Therefore, it is to be understood that, within the scope of the appended claims, the invention can be practiced otherwise than has been specifically shown and described.

What is claimed is:

1. In a burner of the type comprising a motor driven blower, an air tube having an inlet end portion and an outlet end portion, a housing forming an air flow path between said blower and said air tube, a nozzle for spraying liquid fuel toward the outlet end portion of the air tube and a conduit for feeding the fuel to said nozzle, the improvement comprising an air flow control device comprising a first air flow restrictor disposed between said blower and said nozzle, a second air flow restrictor disposed downstream of said first air flow restrictor in a direction of air flow and near said nozzle, a structure that operatively connects said first air flow restrictor and said second air flow restrictor together, and a mechanism adapted to adjust the position of both said first air flow restrictor and said second air flow restrictor to control air pressure and flow rate, wherein said first air flow restrictor is adapted to throttle a major amount of the air in said air tube through at least one throttle opening and said second air flow restrictor is adapted to accept substantially all of the air flowing through the at least one said throttle opening, wherein said first air flow restrictor and said second air flow restrictor are constructed and arranged relative to one another such that when said first air flow restrictor is positioned by said mechanism to achieve the substantially minimum level of air flow in the air tube past said first air flow restrictor, said second air flow restrictor is positioned by said mechanism to achieve the substantially minimum level of air flow in the air tube past said second air flow restrictor.

2. The improvement of claim 1 wherein said mechanism comprises a component connected to said conduit and a member that moves so as to impart motion to said component.

3. The improvement of claim 2 wherein said conduit has a portion that extends externally of said housing, said conduit portion being connected to said component.

4. The improvement of claim 2 wherein said component comprises at least one plate connected to said conduit and said member is eccentric whereby rotation of said member moves said at least one plate.

5. The improvement of claim 1 wherein said first air flow restrictor and said second air flow restrictor are connected to said conduit and said mechanism is adapted to move said conduit.

6. The improvement of claim 1 wherein said first air flow restrictor comprises a first plate and said second air flow restrictor comprises a second plate.

7. The improvement of claim 6 further comprising a first ring disposed around a periphery of said first plate and a second ring disposed around a periphery of said second plate.

8. The improvement of claim 7 wherein said second ring has a tapered surface that extends progressively inwardly or outwardly relative to the air flow direction and said second plate has a circumferential surface that is sized so as to form an aperture of various widths with said tapered surface of said second ring.

9. In a burner of the type comprising a motor driven blower, an air tube having an inlet end portion and an outlet end portion, a housing forming an air flow path between said blower and said air tube, a nozzle for spraying liquid fuel toward the outlet end portion of the air tube and a conduit for feeding the fuel to said nozzle, the improvement comprising an air flow control device comprising a first air flow restrictor disposed between said blower and said nozzle, a second air flow restrictor disposed downstream of said first air flow restrictor in a direction of air flow, and a mechanism adapted to adjust the position of a portion of said first air flow restrictor and a portion of said second air flow restrictor to control air flow, wherein said mechanism comprises a component connected to said conduit and a member that moves so as to impart motion to said component, said conduit having a portion that extends externally of said housing, said conduit portion being connected to said component, wherein said mechanism comprises an apertured support that extends outwardly from said housing, said component comprising an arm that is pivotally connected to said housing, a protrusion extending outwardly from said arm, and said member comprising a threaded rod carried in the aperture of said support, including stop members that are fixed on said rod and flank said protrusion, wherein rotation of said rod causes said stop members to engage said protrusion and pivotally move said arm.

10. In a burner of the type comprising a motor driven blower, an air tube having an inlet end portion and an outlet end portion, a housing forming an air flow path between said blower and said air tube, a nozzle for spraying liquid fuel toward the outlet end portion of the air tube and a conduit for feeding the fuel to said nozzle, the improvement comprising an air flow control device comprising a first air flow restrictor disposed between said blower and said nozzle, a second air flow restrictor disposed downstream of said first air flow restrictor in a direction of air flow, and a mechanism adapted to adjust the position of a portion of said first air flow restrictor and a portion of said second air flow restrictor to control air flow, wherein said mechanism comprises a component connected to said conduit and a member that mechanism comprises a component connected to said conduit and a member that moves so as to impart motion to said component, wherein said mechanism comprises an apertured support that extends outwardly from said housing, and said component comprises a threaded rod carried in the aperture of said support and connected to said conduit, said member comprising internal threads that engage said rod, wherein rotation of said member against said support causes movement of said rod.

11. In a burner of the type comprising a motor driven blower, an air tube having an inlet end portion and an outlet end portion, a housing forming an air flow path between said blower and said air tube, a nozzle for spraying liquid fuel toward the outlet end portion of the air tube and a conduit for feeding the fuel to said nozzle, the improvement comprising an air flow control device comprising a first air flow restrictor disposed between said blower and said nozzle, a second air flow restrictor disposed downstream of said first air flow restrictor in a direction of air flow, and a mechanism adapted to adjust the position of a portion of said first air flow restrictor and a portion of said second air flow restrictor to control air flow, wherein said mechanism comprises a component connected to said conduit and a member that moves so as to impart motion to said component, wherein said component comprises an arm that is pivotally connected to said housing, and said member comprises a rack and pinion, one of said rack and said pinion being connected to said housing and the other of said rack and said pinion being connected to said arm, wherein motion imparted relative to said rack and said pinion pivotally moves said arm.

12. In a burner of the type comprising a motor driven blower, an air tube having an inlet end portion and an outlet end portion, a housing forming an air flow path between said blower and said air tube, a nozzle for spraying liquid fuel toward the outlet end portion of the air tube and a conduit for feeding the fuel to said nozzle, the improvement comprising an air flow control device comprising a first air flow restrictor disposed between said blower and said nozzle, a second air flow restrictor disposed downstream of said first air flow restrictor in a direction of air flow, and a mechanism adapted to adjust the position of a portion of said first air flow restrictor and a portion of said second air flow restrictor to control air flow, wherein said mechanism comprises a component connected to said conduit and a member that moves so as to impart motion to said component, wherein said component comprises a plurality of plates each being capable of individual connection to said conduit and said member is eccentric such that rotation of said member moves a selected one of said plates, wherein each of said plates includes a conduit opening for receiving said conduit and an opening for receiving said member, a location of the conduit opening in one of said plates being offset from a location of the conduit opening in another of said plates.

13. In a burner of the type comprising a motor driven blower, an air tube having an inlet end portion and an outlet end portion, a housing forming an air flow path between said blower and said air tube, a nozzle for spraying liquid fuel toward the outlet end portion of the air tube and a conduit for feeding the fuel to said nozzle, the improvement comprising an air flow control device comprising a first air flow restrictor disposed between said blower and said nozzle, a second air flow restrictor disposed downstream of said first air flow restrictor in a direction of air flow, and a mechanism adapted to adjust the position of a portion of said first air flow restrictor and a portion of said second air flow restrictor to control air flow, wherein said mechanism comprises a component connected to said conduit and a member that moves so as to impart motion to said component, wherein said component comprises at least one plate connected to said conduit and said member is eccentric such that rotation of said member moves the at least one said plate, wherein the at least one said plate comprises an oblong shaped opening that receives said member and rotation of said member in said oblong shaped opening enables movement of said plate within a predetermined range of distance.

14. In a burner of the type comprising a motor driven blower, an air tube having an inlet end portion and an outlet end portion, a housing forming an air flow path between said blower and said air tube, a nozzle for spraying liquid fuel toward the outlet end portion of the air tube and a conduit for feeding the fuel to said nozzle, the improvement comprising an air flow control device comprising a first air flow restrictor disposed between said blower and said nozzle, a second air flow restrictor disposed downstream of said first air flow restrictor in a direction of air flow, and a mechanism adapted to adjust the position of said first air flow restrictor and said second air flow restrictor to control air flow, wherein said first air flow restrictor comprises a first plate and a first ring disposed around a periphery of said first plate and said second air flow restrictor comprises a second plate and a second ring disposed around a periphery of said second plate, wherein said first ring has a contoured surface with a curvature that extends progressively inwardly or outwardly relative to an air flow direction and said first plate has a circumferential surface that is sized so as to form an aperture of various widths with said contoured surface of said first ring, wherein said aperture, along with said second air flow restrictor, is effective to enable a blower pressure upstream of said first air flow restrictor, P1, to drop and the air flow rate to increase essentially uniformly with an increase in a setting of the air flow control device while enabling a throttled pressure, P2, between said first air flow restrictor and said second air flow restrictor, to follow a prescribed value for each air flow rate and corresponding fuel flow rate.

15. The burner of claim 14 wherein the pressure P2 ranges from 0.4 to 1.1 inches water column.

16. A method of regulating air flow in a burner of the type comprising a motor driven blower, an air tube having an inlet end portion and an outlet end portion, a housing forming an air flow path between said blower and said air tube, a nozzle for spraying liquid fuel toward the outlet end portion of the air tube and a conduit for feeding the fuel to said nozzle, said method comprising a two-stage regulation of air flow and pressure comprising making a single adjustment that moves both a first air flow restrictor located in said air tube between said blower and said nozzle and a second air flow restrictor which is located downstream of said nozzle, wherein said first air flow restrictor and said second air flow restrictor are constructed and arranged relative to one another such that when said single adjustment positions said first air flow restrictor to achieve the substantially minimum level of air flow in the air tube past said first air flow restrictor, said second air flow restrictor is positioned by said single adjustment to achieve the substantially minimum level of air flow in the air tube past said second air flow restrictor.

17. The method of claim 16 comprising regulating with said first air flow restrictor and said second air flow restrictor air at a pressure P1 in a first zone located between said blower and said first air flow restrictor to reduce said pressure P1 to a pressure P2 in a second zone between said first air flow restrictor and said second air flow restrictor.

18. The method of claim 17 wherein said pressure P1 ranges from 1.75 to 4.50 inches water column and said pressure P2 ranges from 0.4 to 1.1 inches water column.

19. The method of claim 17 comprising, as a result of said single adjustment, movement of said first flow restrictor to throttle a major amount of the air in said air tube through at least one throttle opening of said first air flow restrictor, and movement of said second air flow restrictor to a position at which said second air flow restrictor accepts substantially all of the air flowing through the at least one said throttle opening.

20. The method of claim 16 comprising regulating air downstream of said first air flow restrictor to be at a pressure P2 ranging from 0.4 to 1.1 inches water column.

21. The method of claim 16 wherein a component of said first air flow restrictor and a component of said second air flow restrictor are connected to said conduit, comprising moving said conduit so as to move said first air flow restrictor component and said second air flow restrictor component.

22. The method of claim 21 comprising moving said first air flow restrictor component and said second air flow restrictor component within said air tube.

23. The method of claim 21 comprising moving with an air flow control mechanism a portion of said conduit located externally of said housing so as to move said first air flow restrictor component and said second air flow restrictor component.

24. In a burner of the type comprising a motor driven blower, an air tube having an inlet end portion and an outlet end portion, a housing forming an air flow path between said blower and said air tube, a nozzle for spraying liquid fuel toward the outlet end portion of said air tube and a conduit for feeding the fuel to said nozzle, the improvement comprising a two-stage air control device comprising a first air flow restrictor disposed upstream of said nozzle in the air tube relative to a direction of air flow and a second air flow restrictor disposed downstream of said nozzle, a structure that operatively connects said first air flow restrictor and said second air flow restrictor together, and a mechanism adapted to adjust the position of both said first air flow restrictor and said second air flow restrictor to control air pressure and flow rate with a single adjustment, wherein said first air flow restrictor and said second air flow restrictor are constructed and arranged relative to one another such that when said first air flow restrictor is positioned by said mechanism to achieve the substantially minimum level of air flow in the air tube past said first air flow restrictor, said second air flow restrictor is positioned by said mechanism to achieve the substantially minimum level of air flow in the air tube past said second air flow restrictor.

25. The improvement of claim 24 wherein the said fuel conduit is a straight cylindrical tube located concentric with said air tube.

26. The improvement of claim 25 wherein said fuel conduit is moveable along a central axis of said air tube and is an integral part of said two-stage air control device.

27. The improvement of claim 24 wherein said second air flow restrictor is so configured as to accept the air from said first air flow restrictor at a prescribed pressure, P2, and to discharge a prescribed air flow uniformly increasing over a full burner range in proportion to movement of said mechanism over a full range of movement from zero to a maximum during said single adjustment.

28. The improvement of claim 27 wherein said second air flow restrictor comprises a moveable round retention plate and a stationary retention ring which are concentric with the air tube and configured to deliver air to a flame zone near said nozzle at an optimal velocity and flow rate for each corresponding fuel rate of the burner.

29. The improvement of claim 28 wherein said retention plate includes fixed radially extending openings and a round central opening.

30. The improvement of claim 24 wherein said first air flow restrictor is so configured as to reduce a blower pressure, P1, to a lower pressure, P2, for each setting of said mechanism from zero to a maximum setting.

31. The improvement of claim 24 wherein said first air flow restrictor comprises a perforated circular throttle plate affixed to said fuel conduit and moveable along a central axis of said air tube, and surrounding said throttle plate is a stationary contoured throttle ring affixed concentrically inside said air tube.

32. The improvement of claim 24 wherein said first air flow restrictor and said second air flow restrictor include components affixed to, and coaxial with, the air tube, said second air flow restrictor being located at said outlet end portion of the air tube.

33. The improvement of claim 32 wherein said mechanism is disposed outside said housing and can move said conduit axially between positions corresponding to a zero setting and a maximum setting.

34. In a burner of the type comprising a motor driven blower, an air tube having an inlet end portion and an outlet end portion, a housing forming an air flow path between said blower and said air tube, a nozzle for spraying liquid fuel toward the outlet end portion of said air tube and a conduit for feeding the fuel to said nozzle, the improvement comprising a two-stage air control device comprising a first air flow restrictor disposed upstream of said nozzle in the air tube relative to a direction of air flow and a second air flow restrictor disposed downstream of said nozzle, a structure that operatively connects said first air flow restrictor and said second air flow restrictor together, and a mechanism adapted to adjust the position of both said first air flow restrictor and said second air flow restrictor to control air pressure and flow rate with a single adjustment, wherein said first and said second air flow restrictor each comprise moveable circular plates, said first air flow restrictor and said second air flow restrictor each comprising a ring coaxial with and affixed to said air tube and disposed around one of said circular plates, wherein trailing edges of each of said plates relative to the air flow direction coincide with a minimum inner diameter of each said corresponding ring when said mechanism is calibrated at zero.

35. The improvement of claim 34 wherein said moveable plates can be adjusted axially from a zero setting position to any position up to said maximum setting position, wherein a blower pressure, P1, will drop and the air flow rate will increase essentially uniformly with an increase in the setting while a throttled pressure, P2, caused by said first air flow restrictor and said second air flow restrictor, follows a prescribed value for each air flow rate and corresponding fuel flow rate.

36. In a burner of the type comprising a motor driven blower, an air tube having an inlet end portion and an outlet end portion, a blower housing forming an air flow path between said blower and said air tube, a nozzle for spraying liquid fuel toward the outlet end portion of said air tube and a conduit for feeding the fuel to said nozzle, the improvement comprising: a two-stage air control device comprising a first air flow restrictor disposed upstream of said nozzle in the air tube relative to a direction of air flow and a second air flow restrictor disposed downstream of said nozzle, wherein said first air flow restrictor comprises a plate and a tapered member coaxial with said air tube, one of said ring and said tapered member having an inner opening that receives the other of said ring and said plate, a structure that operatively connects said first air flow restrictor and said second air flow restrictor together, and a mechanism adapted to adjust the position of both said first air flow restrictor and said second air flow restrictor to control air pressure and flow rate with a single adjustment, wherein said first air flow restrictor is constructed and arranged such that one of said plate and said ring is located axially along the air tube within the other of said plate and said ring, from a first position, in which said mechanism positions one of said plate and said ring to achieve the maximum level of air flow in the air tube past said first air flow restrictor, through a second position, in which said mechanism positions one of said plate and said ring to achieve the minimum level of air flow in the air tube past said first air flow restrictor.

37. The burner of claim 36 wherein said first air flow restrictor and said second air flow restrictor are constructed and arranged relative to one another such that when said first air flow restrictor is positioned to achieve the minimum level of air flow in the air tube past said first air flow restrictor, said second air flow restrictor is positioned to achieve the minimum level of air flow in the air tube past said second air flow restrictor.

* * * * *

UNITED STATES PATENT AND TRADEMARK OFFICE
Certificate

Patent No. 6,244,855 B1 Patented: June 12, 2001

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Victor J. Turk, Elyria, OH; John M. Laisy, N. Royalton, OH; Len Fisher, Colrain, MA; and Charles L. Green, Nanuet, NY.

Signed and Sealed this Thirtieth Day of March 2004.

IRA S. LAZARUS
*Supervisory Patent Examiner*
Art Unit 3749